US006312106B1

(12) United States Patent
Walker

(10) Patent No.: US 6,312,106 B1
(45) Date of Patent: Nov. 6, 2001

(54) METHOD AND APPARATUS FOR TRANSFERRING INFORMATION BETWEEN A REPLACEABLE CONSUMABLE AND A PRINTING DEVICE

(75) Inventor: Ray A. Walker, Eugene, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/295,080

(22) Filed: Apr. 20, 1999

(51) Int. Cl.[7] ..... B41J 2/14
(52) U.S. Cl. ..... 347/50
(58) Field of Search ..... 347/85, 86, 87, 347/19, 50

(56) References Cited

U.S. PATENT DOCUMENTS

| | | | | |
|---|---|---|---|---|
| 5,049,898 | | 9/1991 | Arthur et al. | 347/19 |
| 5,266,968 | * | 11/1993 | Stephenson | 346/76 PH |
| 5,396,078 | * | 3/1995 | Klaus et al. | 250/551 |
| 5,699,091 | * | 12/1997 | Bullock et al. | 347/19 |
| 6,027,195 | * | 2/2000 | Gauthier et al. | 347/5 |
| 6,039,430 | * | 3/2000 | Helterline et al. | 347/19 |

FOREIGN PATENT DOCUMENTS

WO/98/52762 11/1998 (WO) ..... B41J/2/01

OTHER PUBLICATIONS

Motorola, "RFID: Everything You Need to Know" 11/11/97, pp. 1–19.

* cited by examiner

*Primary Examiner*—N. Le
*Assistant Examiner*—Michael Nghiem
(74) *Attorney, Agent, or Firm*—Kevin B. Sullivan

(57) ABSTRACT

The present invention relates to a marking engine for use in a marking machine. The marking engine is responsive to control signals for selectively depositing marking material on media. The marking engine includes a housing associated with the marking engine. The housing is configured for docking with the printing system. The housing has an undocked position and a docked position wherein the housing is secured to a receiving station associated with the marking machine. Also included is a radio frequency linking device mounted to the housing so that there is substantially no relative movement between the radio frequency linking device and a corresponding radio frequency linking device associated with the receiving station when the marking engine is in the docked position with the marking machine. The radio frequency linking device provides a radio frequency link for transferring information between the marking engine and the marking machine.

22 Claims, 6 Drawing Sheets

METHOD AND APPARATUS FOR TRANSFERRING INFORMATION BETWEEN A REPLACEABLE CONSUMABLE AND A PRINTING DEVICE

BACKGROUND OF THE INVENTION

The present invention relates to printing systems that make use of a replaceable printing component. More particularly, the present invention relates to replaceable printing components that include an electrical storage device for providing information to the printing system.

In the case where the printing system is an ink jet printing system an ink-jet printhead is frequently mounted within a carriage that is moved back and forth across a print media, such as paper. As the printhead is moved across the print media, a control system activates the printhead to deposit or eject ink droplets onto the print media to form images and text. Ink is provided to the printhead by a supply of ink that is either carried by the carriage or mounted to the printing system to not move with the carriage. For the case where the ink supply is not carried with the carriage, the ink supply can be intermittently or continuously connected to the printhead for replenishing the printhead. In either case, the replaceable printing components, such as the ink container and the printhead, require periodic replacement. The ink supply is replaced when exhausted. The printhead is replaced at the end of printhead life.

In the case where the printing system is an electrophotographic printing system the replaceable consumable is typically the electrophotographic engine frequently referred to as a toner cartridge. The toner cartridge often includes an intermediate imaging device such as a drum and an imaging material such as toner. The drum is charged using an energy source such as a scanning laser. The imaging material is attracted to the charged drum and is then transferred to print media. The replaceable consumable is either a supply of imaging material or the entire toner cartridge.

It is frequently desirable to alter printer parameters or provide information to the printer concurrently with the replacement of the replaceable printing components such as discussed in U.S. patent application Ser. No. 08/584,499 entitled "Replaceable Part With Integral Memory For Usage, Calibration And Other Data" assigned, now U.S. Pat. No. 5,699,091 filed Jan. 8, 1996, now U.S. Pat. No. 5,699,091 to the assignee of the present invention. U.S. patent application Ser. No. 08/584,499, discloses the use of a memory device, which contains parameters relating to the replaceable printing component. The installation of the replaceable printing component allows the printer to access the replaceable part parameters to insure high print quality. By incorporating the memory device into the replaceable printing component and storing replaceable part parameters in the memory device within the replaceable component the printing system can determine these parameters upon installation into the printing system. This automatic updating of printer parameters frees the user from having to update printer parameters each time a replaceable component is newly installed. Automatically updating printer parameters with replaceable printing component parameters insures high print quality. In addition, this automatic parameter updating tends to ensure the printer is not inadvertently damaged due to improper operation, such as, operating after the supply of ink is exhausted or operation with the wrong or non-compatible printer components.

It is important that the exchange of information between the printer and the replaceable printing component be accomplished in a highly reliable manner. One problem associated with the use of electrical contacts or terminals positioned on the replaceable printing component is that these electrical contacts are subject to contamination. Contamination can result from the handling that transfers contaminants such as hand oils and salts that are frequently present in human skin. This contamination may be transferred to the electrical contacts associated with the printer. Contamination also can result from leakage from the replaceable printing component that can contaminate the electrical contacts. For example, in the case of ink jet printing leakage of ink from the ink container or printhead may contaminate the electrical contacts. Inks used for ink-jet printing typically make use of solvents and surfactants that over time can result in corrosion of the electrical contacts preventing proper electrical contact between the printer and ink container. In addition, liquid contaminates can result in the shorting of these electrical contacts resulting in a faulty electrical interconnect and possibly system failure.

Another problem associated with the use of electrical contacts or terminals positioned on the outer portion of the replaceable consumable is that these contacts are subject to mechanical damage to the contacts such as scraping, denting or pealing, to name a few. This damage, if sufficient, may result in reliability problems or failures of the electrical interconnect between the printer and the replaceable consumable.

Still another problem associated with the use of electrical terminals positioned on the outer portion of the replaceable consumable is that these terminals subject the memory or storage device to electrostatic discharge (ESD). Electrostatic discharge results from the electric terminals contacting a charged surface resulting in a discharge through the storage device. This discharge can result in catastrophic failure or reduce lifetime or reliability of the storage device. Storage devices such as CMOS semiconductor devices are particularly susceptible to electrostatic discharge damage.

There is an ever present need for techniques for transferring information between a replaceable printing component and the printer which does not suffer from the above shortcomings. This technique should be reliable and result in relatively low manufacturing costs to maintain a relatively low overall cost of the printer.

SUMMARY OF THE INVENTION

The present invention relates to a marking engine for use in a marking machine. The marking engine is responsive to control signals for selectively depositing marking material on media. The marking engine includes a housing associated with the marking engine. The housing is configured for docking with the printing system. The housing has an undocked position and a docked position wherein the housing is secured to a receiving station associated with the marking machine. Also included is a radio frequency linking device mounted to the housing so that there is substantially no relative movement between the radio frequency linking device and a corresponding radio frequency linking device associated with the receiving station when the marking engine is in the docked position with the marking machine. The radio frequency linking device provides a radio frequency link for transferring information between the marking engine and the marking machine.

DETAILED DESCRIPTION OF THE PREFERRED EMBODIMENT

Figure 1:
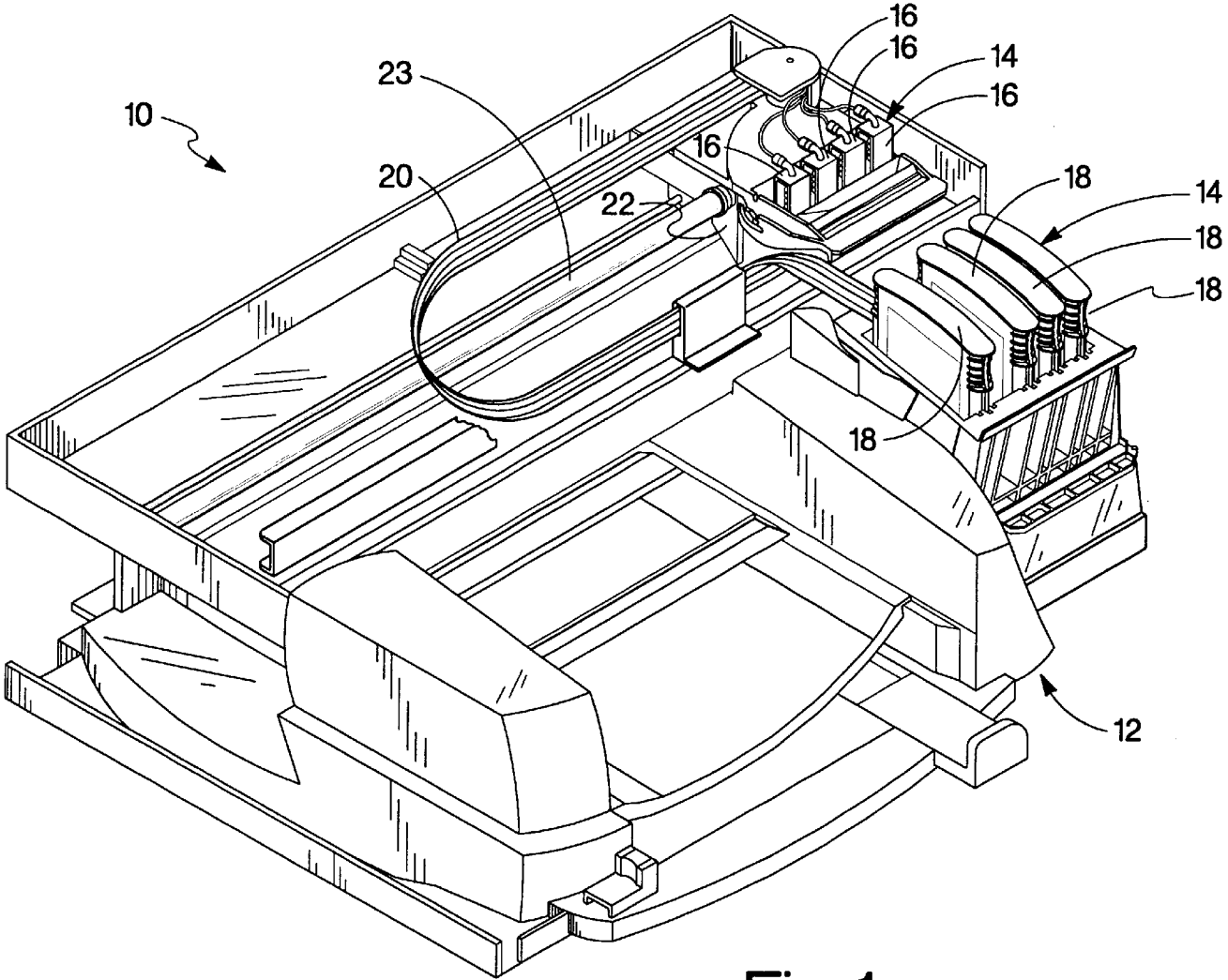
FIG. 1 depicts a perspective view of an exemplary ink-jet printing system, shown with the cover removed, that incorporates removable printing components of the present invention.

FIG. 1 is a perspective view of one exemplary embodiment of an ink-jet printing system 10 of the present invention shown with its cover removed. The ink-jet printing system 10 includes a printer portion 12 having a plurality of replaceable printing components 14 installed therein. The plurality of replaceable printing components 14 include a plurality of printheads 16 for selectively depositing ink in response to control signals and a plurality of ink containers 18 for providing ink to each of the plurality of printheads 16. Each of the plurality of printheads 16 is fluidically connected to each of the plurality of ink containers 18 by a plurality of flexible conduits 20.

Each of the plurality of printheads 16 is mounted in a scanning carriage 22. The scanning carriage moves on a carriage support rod 23 to scan past a print media (not shown) as the print media is stepped through a print zone. As the plurality of printheads are moved relative to the print media, ink is selectively ejected from a plurality of orifices in each of the plurality of the printheads 16 to form images and text.

One aspect of the present invention is a method and apparatus for transferring information between the replaceable printing components 14 and the printer portion 12. An electrical storage device is associated with each of the replaceable printing components 14. The electrical storage device contains information related to the particular replaceable printer component 14. Installation of the replaceable printing component 14 into the printer portion 12 allows information to be transferred between the electrical storage device and the printing portion 12 to insure proper operation of the printing system 10. The information provided from the replaceable printing component 14 to the printing portion 12 tends to prevent operation of the printing system 10 in a manner which damages the printing system 10 or which reduces the print quality. An important aspect of the present invention is the method and apparatus for transferring information between the printing component 14 and the printer portion 12 which will be discussed in more detail with respect to FIGS. 2–6.

Although the printing system 10 shown in FIG. 1 makes use of ink containers 18 which are mounted off of the scanning carriage 22, the present invention is equally well suited for other types of printing system configurations. One such configuration is one where the replaceable ink containers 18 are mounted on the scanning carriage 22. Alternatively, the printhead 16 and the ink container 18 may be incorporated into an integrated printing cartridge that is mounted to the scanning carriage 22. The printing system 10 is alternatively an electrophotographic printing system 10 that makes use of a replaceable consumable 14 that is a replaceable toner cartridge. Upon installation of the toner cartridge information is transferred between an electrical storage device on the toner cartridge and the printer portion 12 that receives the toner cartridge. The printing system 10 of the present invention may be used in a wide variety of applications such as facsimile machines, postal franking machines and large format type printing systems suitable for use in displays and outdoor signage, to name a few.

Figure 2:
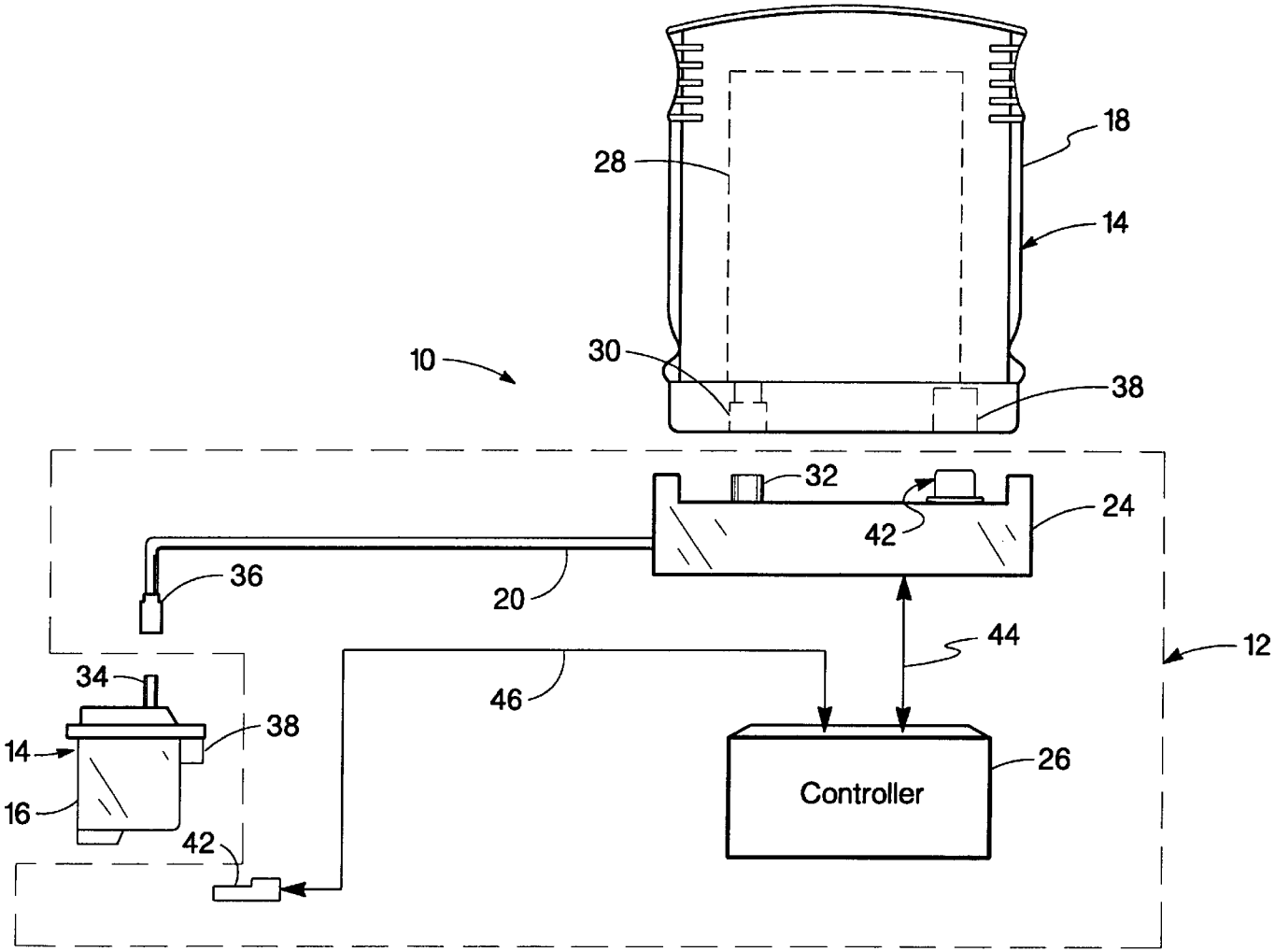
FIG. 2 depicts a schematic representation of the ink-jet printing system shown in FIG. 1 illustrating a removable ink container and printhead each of which contain a linking device for transferring information between the removable printing components and printer portion.

FIG. 2 depicts a simplified schematic representation of the ink-jet printing system 10 of the present invention shown in FIG. 1. FIG. 2 is simplified to illustrate a single printhead 16 and a single ink container 18 for accomplishing the printing of a single color. For the case where more than one color is desired a plurality of printheads 16 are typically used with each printhead 16 having an associated ink container 18.

The ink-jet printing system 10 of the present invention includes a printer portion 12 having replaceable printing components 14. The replaceable printing components 14 include a printhead 16 and an ink container 18. The printer portion 12 includes an ink container receiving station 24 and a controller 26. With the ink container 18 properly inserted into the ink container receiving station 24, a fluidic coupling is established between the ink container 18 and the printer portion 12. The fluidic coupling allows ink stored within the ink container 18 to be provided to the printhead 16.

The ink container 18 includes a reservoir 28 for storing ink therein. A fluid outlet 30 is provided that it is in fluid communication with the fluid reservoir 28. The fluid outlet 30 is configured for connection to a complimentary fluid inlet 32 associated with the ink container receiving station 24.

The printhead 16 includes a fluid inlet 34 configured for connection to a complimentary fluid outlet 36 associated with the printing portion 12. With the printhead 16 properly inserted into the scanning carriage 22 (shown in FIG. 1) fluid communication is established between the printhead and the ink container 18 by way of the flexible fluid conduit 20.

Each of the replaceable printing components 14 such as the printhead 16 and the ink container 18 include a linking device 38 such as a radio frequency linking device. Associated with each of the linking devices 38 is an electrical storage device or memory for storing information related to the respective replaceable printer component 14. A corresponding linking device 42 associated with the printer portion 12 for exchanging information with the corresponding linking device 38 associated with the replaceable printing component.

An information link is selectively established between the printer portion 12 and each of the replaceable printing components such as the printhead 16 and ink container 18. The information link allows information to be passed between the printer portion 12 and each of the printhead 16 and the ink container 18 to insure the operation of the printer portion 12 is compatible with the ink contained in the ink container 18 and the printhead 16 thereby achieving high print quality and reliable operation of the printing system 10.

With the ink container 18 properly inserted into the ink container receiving station 24 the linking device 38 is disposed and arranged relative to the linking device 42 associated with the printer portion 12 to allow information to be passed between linking device 42 and linking device 38 without direct electrical contact. Similarly, with the printhead 16 properly inserted into a corresponding printhead receiving station (not shown) the linking device 38 is disposed and arranged relative to the linking device 42 to allow information to be passed between linking device 42 and linking device 38 without direct electrical contact.

The controller 26 controls the transfer of information between the printer portion 12 and each of the printhead 16 and the ink container 18. In addition, the controller 26 controls the relative movement of the printhead 16 and the print media as well as selectively activating the printhead to deposit ink on print media.

Although linking devices 38 associated with each of the ink container 18 and the printhead 16 are given the same element number to indicate these devices are similar devices, the information stored in the electrical storage device associated with the ink container 18 will, in general, be different from the information stored in the electrical storage device associated with the printhead 16. Similarly, the information stored in electrical storage device associated with each ink container of the plurality of ink containers 18 will in general be different and unique to be particular ink container of the plurality of ink containers 18.

Figure 3:
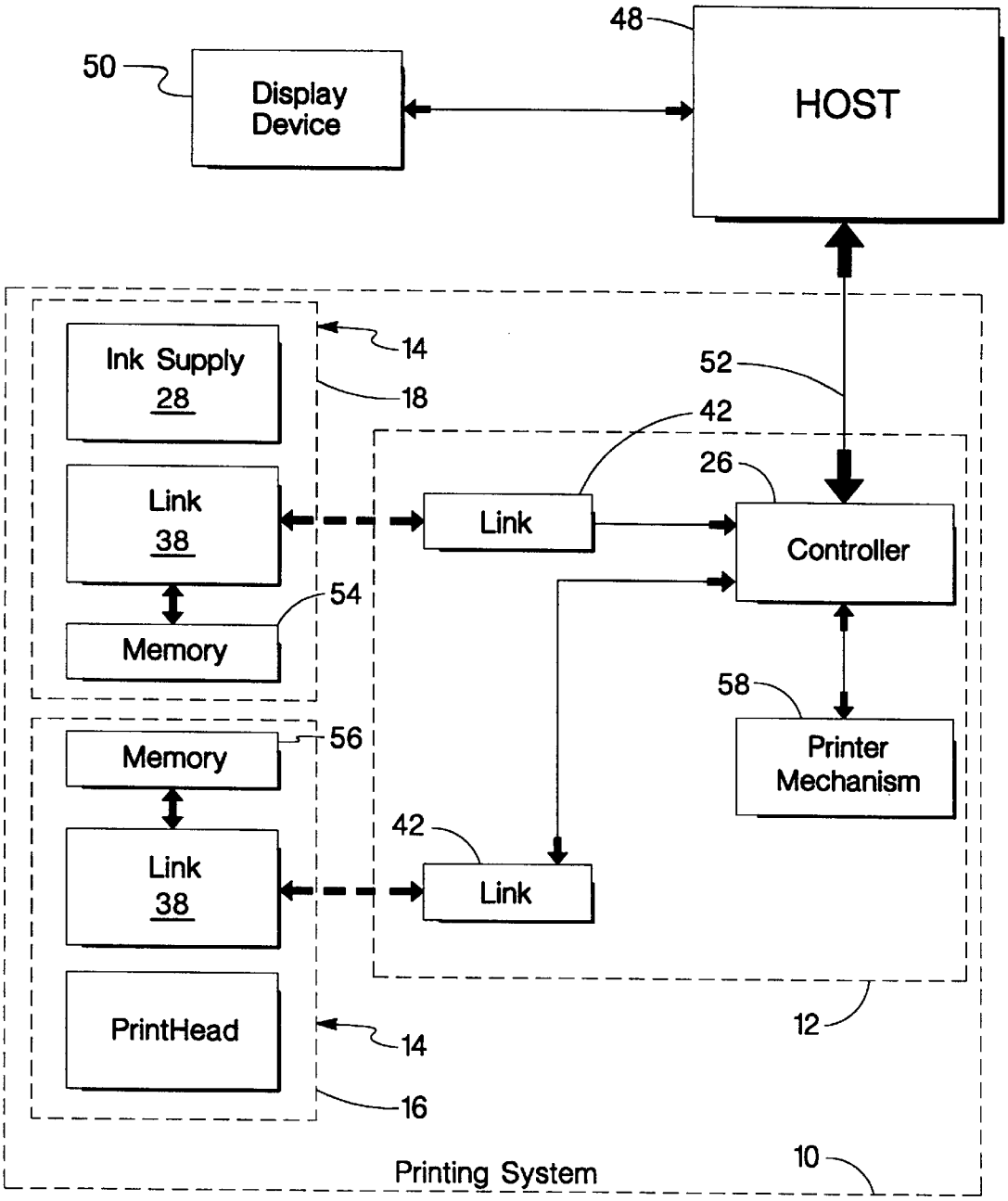
FIG. 3 depicts a schematic block diagram of the ink-jet printing system of FIG. 1 shown connected to a host and which includes a removable ink container and printhead each of which contain the linking device.

FIG. 3 represents a simplified block diagram of the printing system 10 of the present invention shown connected to an information source or host computer 48. The host computer 48 is shown connected to a display device 50. The host 48 can be a variety of information sources such as a personal computer, work station, or server to name a few, that provides image information to the controller 26 by way of a data link 52. The data link 52 may be any one of a variety of conventional data links such as an electrical link or an infrared link for transferring information between the host 48 and the printing system 10.

Information is transferred between the controller 26 and an electrical storage device or memory 54 associated with the ink container 18 by transferring information between linking devices 42 and 38. Similarly, information is transferred between the controller 26 and an electrical storage device or memory 56 associated with the printhead 16 by transferring information between link 42 and link 38 associated with the printhead 16. In addition, the controller 26 is electrically connected to a printer mechanism 58 for controlling media transport and movement of the carriage 22. The controller 26 makes use of parameters and information provided by the host 48, the memory 54 associated with the ink container 18 and memory 56 associated with the printhead 16 to accomplish printing.

The host computer 48 provides image description information or image data to the printing system 10 for forming images on print media. In addition, the host computer 48 provides various parameters for controlling operation of the printing system 10, which is typically resident in printer control software typically referred to as the "print driver". In order to ensure the printing system 10 provides the highest quality images it is necessary that the operation of the controller 26 compensate for the particular replaceable printer component 14 installed within the printing system 10. It is the electric storage devices 54 and 56 that are associated with the ink container 18 and printhead 16, respectively, that provide parameters which are utilized by the controller 26 to ensure the reliable operation of the printing system 10 and insure high quality print images.

Among the parameters, for example which are stored in electrical storage devices 54 and 56 associated with the replaceable printing components 14 are the following: actual count of ink drops emitted from the printhead 16; a date code associated with the ink container 18; date code of initial insertion of the ink container 18; system coefficients; ink type/color: ink container size; age of the ink; printer model number or identification number; cartridge usage information; just to name a few.

Although the linking devices 38 and 42 of present invention are described herein in the context of an ink jet printing system this is intended as an example only and not intended to limit the scope of Applicants' invention. The linking devices of the present invention are equally well suited to other printer technologies such as electrophotographic printers referred to as laser printers. For electrophotographic printers the linking device 38 is placed on one or more replaceable printing components 14 such as a toner cartridge, a toner container or a replaceable motor, just to name a few. These replaceable printing components 14 are components that are replaceable because they are depleted, have a limited useful life or are specific to a certain type of printing or print media. Some examples of specific types of printing that can require a change in replaceable printing components 14 are color printing, black and white printing, plain paper printing, transparency printing, just to name a few.

The replaceable printing component 14 is alternatively a refurbished replaceable printing component 14. A refurbished replaceable printing component 18 has been reconditioned or refilled with a replacement ink or replacement marking media. The memory 54 is either refurbished or replaced to allow it to provide signals that enable printing with printing system 10. The memory 54 is refurbished to include, among other things, marking material-related information that is indicative of an amount or type of replacement marking material 28.

Figure 4:
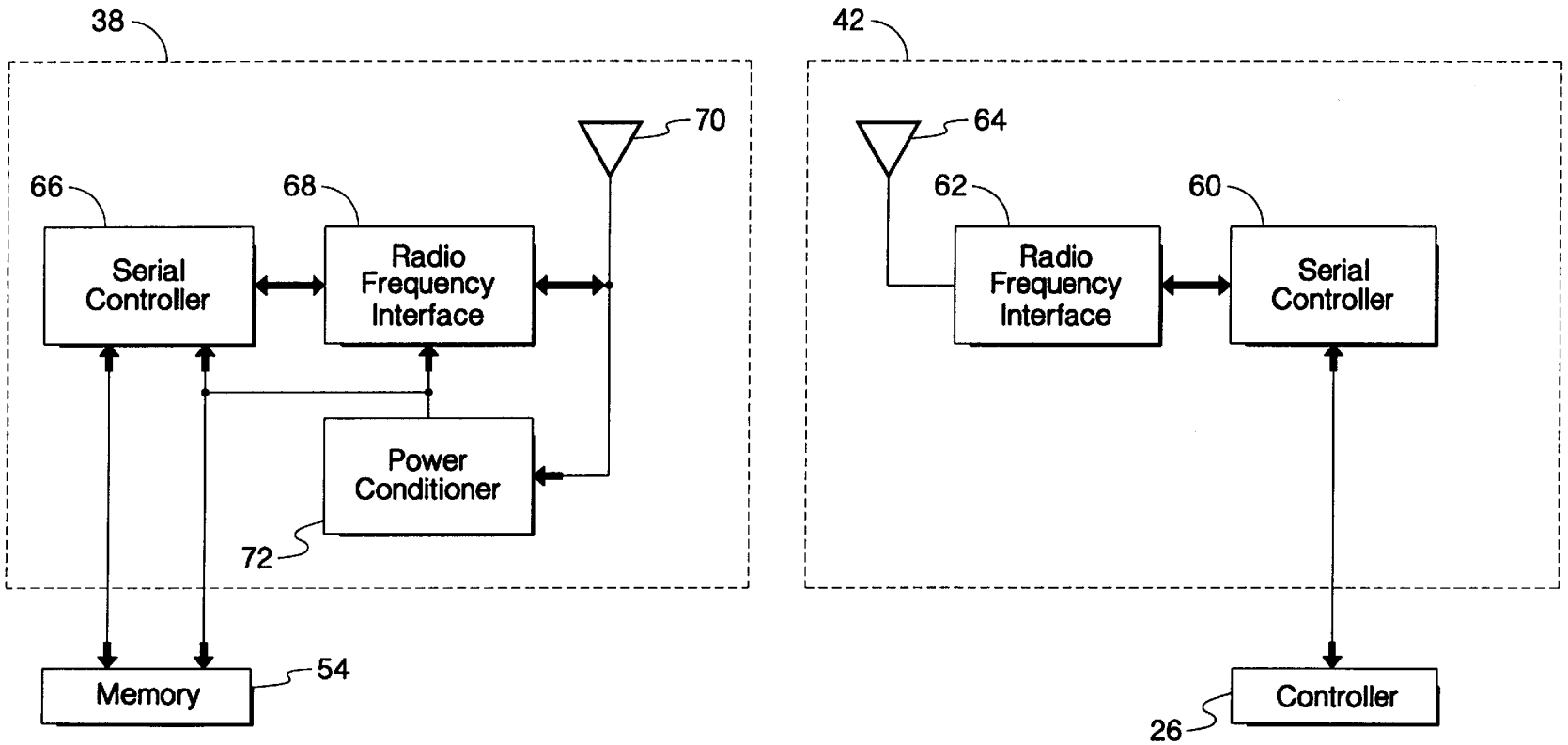
FIG. 4 depicts a schematic representation of the linking device shown in FIG. 2.

FIG. 4 depicts further detail of the linking devices 38 and 42 of the present invention for transferring information between the ink container 18 and the printer portion 12. The linking device 38 associated with the printhead 16 is similar to the linking device 38 associated with the ink container 18 and therefore will not be discussed in detail.

The linking device 42 associated with the printer portion 12 includes a serial controller 60, a radio frequency interface 62 and an antenna 64. The serial controller 60 controls the transfer of information between and the controller 26 associated with the printer portion 12 and the radio frequency interface 62. The serial controller 60 is a microprocessor or a hardware implemented controller that performs all of the necessary interface and data manipulation functions for passing information between the controller 26 and the radio frequency interface 62. One example of this data manipulation is to receive data in a parallel format from the controller 26 and provide the received data in a serial format to the radio frequency interface 62.

The radio frequency interface 62 receives information from the serial controller 60 in a serial fashion and converts this information into a time varying voltage at the antenna 64. This time varying voltage is preferably in a standard radio frequency range such as from 125 kilohertz to 13.56 megahertz. Radio frequencies outside of this range may also be suitable. Transmission of information using a radio frequency technology is used in financial transaction cards provided by financial institutions for financial transactions. These financial transaction cards are sometimes referred to as "smart cards". Similar technology is also used in inventory systems that is sometimes referred to as radio frequency identification technology (RFID).

The linking device 38 associated with the ink container 18 is similar to the linking device 42 associated with the printer portion 12. Similar numbers will be used to identify features of the linking device 38 that are similar to the features of the linking device 42. The linking device 38 includes a serial controller 66, a radio frequency interface 68 and an antenna 70. Provided the antenna 70 associated with linking device 38 is properly orientated and positioned relative to the antenna 64 associated with the linking device 42 voltages are induced on antenna 70 in response to time varying voltages at antenna 64. Information is extracted from the time varying voltages induced on antenna 70 by the radio frequency interface 68. The information is passed from the radio frequency interface 68 to the serial controller 66. In response to command information, the serial controller 66 either stores information in the memory device 54 or retrieves information from the memory device 54 for sending this information to the controller 26 in a process similar to the transfer of information from the controller 26 to the serial controller 66.

The linking device 38 and memory 54 is either powered by an active device such as a battery or by a passive device that stores energy in a storage device such as a capacitor. The energy is provided to the capacitor by voltages induced on the antenna 70. In the preferred embodiment, voltages are induced on the antenna 70 due to time-varying voltages that are applied to antenna 64 by the radio frequency interface 62. The induced voltage at antenna 70 is provided to a power conditioner 72 which converts these time varying voltages into a single polarity voltage that is suitable as a supply voltage for each of the memory 54, serial controller 66, and radio frequency interface 68. In one preferred embodiment the power conditioner 72 rectifies a time-varying voltage that is induced on antenna 70 and filters this rectified voltage to provide a suitable supply voltage. The use of a power conditioner 72 on the linking device 38 eliminates the need for a direct power and ground connection between the replaceable printing component 14 and the printing system 10.

In the case of a passive linking device 38 a time varying electro-magnetic field induces a voltage on antenna 70 to power this device. The modulation of this time varying electro-magnetic field allows information to be transferred to the linking device 38. For example, a carrier signal can be provided by the linking device 42 to induce a time varying voltage at antenna 70. This time varying voltage is rectified and filtered by the power conditioner 72 to provide a supply voltage to the linking device 38 and memory 54. The radio frequency interface 62 modulates the carrier signal such as by varying the frequency, phase or amplitude to transmit information to the linking device 38. Demodulation of the carrier signal allows the radio frequency interface 68 to extract information from the carrier signal. Information is transferred in a similar manner from the linking device 38 back to the linking device 42.

Figure 5:
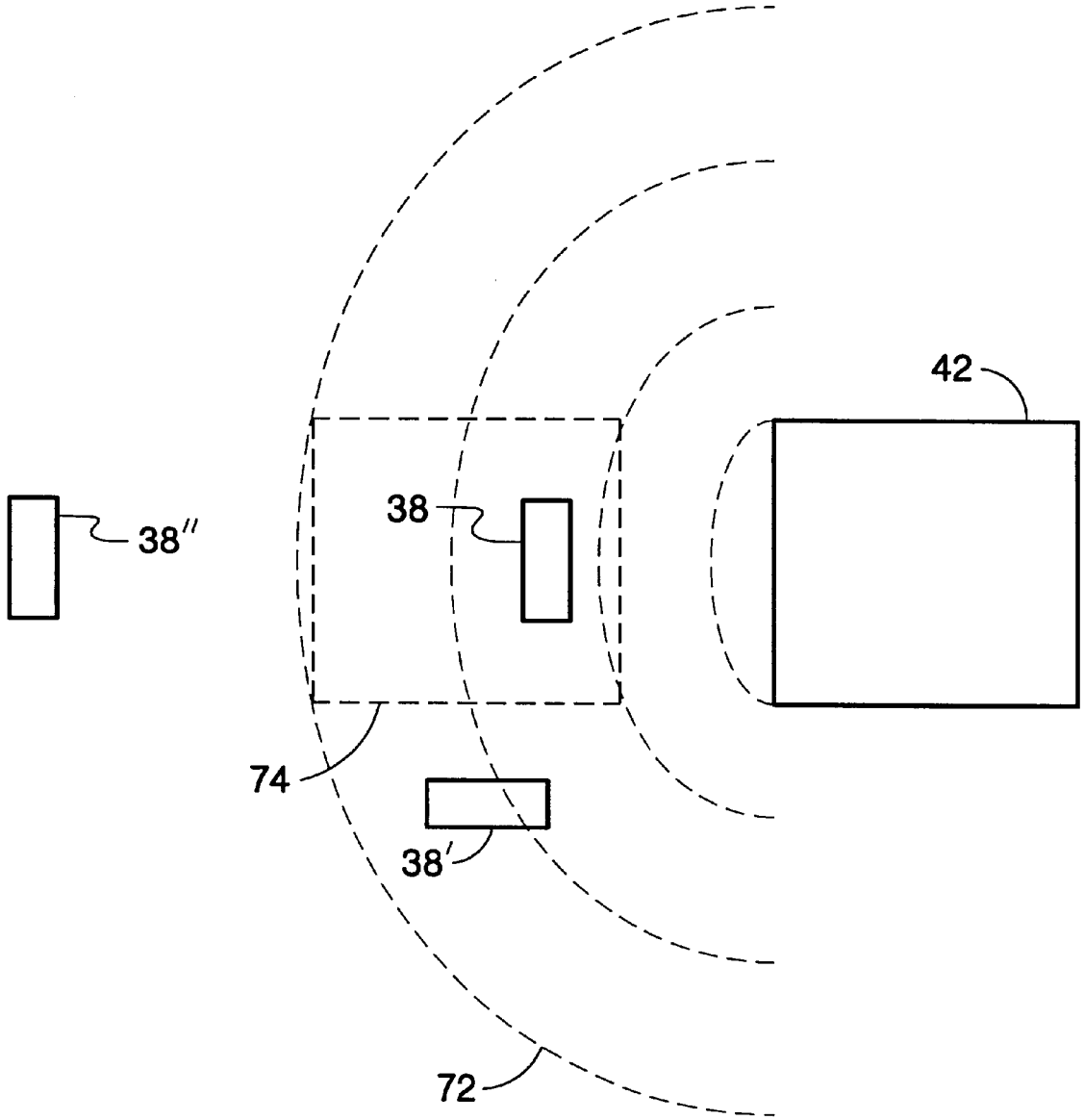
FIG. 5 depicts a plurality of linking devices associated with the replaceable printing component positioned at various orientations and spacing from a linking device associated with the printer portion.

FIG. 5 depicts a schematic representation of the linking device 42 associated with the printer portion 12 and the linking device 38, 38', and 38" associated with the replaceable consumable 14. The linking device 38, 38', and 38" is shown positioned in three different locations, each having different spacing and orientation to the linking device 42. A series of wave fronts 72 are shown representing an electric or magnetic field that is emanated from the linking device 42. This electric or magnetic field has directionality as it is radiated from the linking device 42 as represented by the wave fronts 72 or lines of equal force. Assuming that the radiated electromagnetic field has a limited field strength or that the linking device 38 has a limited sensitivity a capture region 74 can be defined. The capture region or read range 74 is a region whereupon the positioning the linking device 38 within this capture region 74 with the proper orientation to the linking device 42 allows information to be reliably transferred between linking devices 38 and 32.

Linking device 38' is shown positioned within the electrical or magnetic field emanating from the linking device 42, however, the orientation of the linking device 38' is not properly aligned with the electrical or magnetic field to achieve optimal induced voltage in the antenna 70 associated with the linking device 38'. Therefore, for a given field strength emanated by the linking device 42 and a given sensitivity for the linking device 38' a proper link can not be established.

Similarly, the positioning of a linking device 38" illustrates proper orientation with the linking device 42, however, the spacing from the linking device too great for a sufficient voltage to be induced on the antenna 70 associated with the linking device 38". Therefore, a proper information link can not be established between linking devices 42 and 38".

Figure 6:
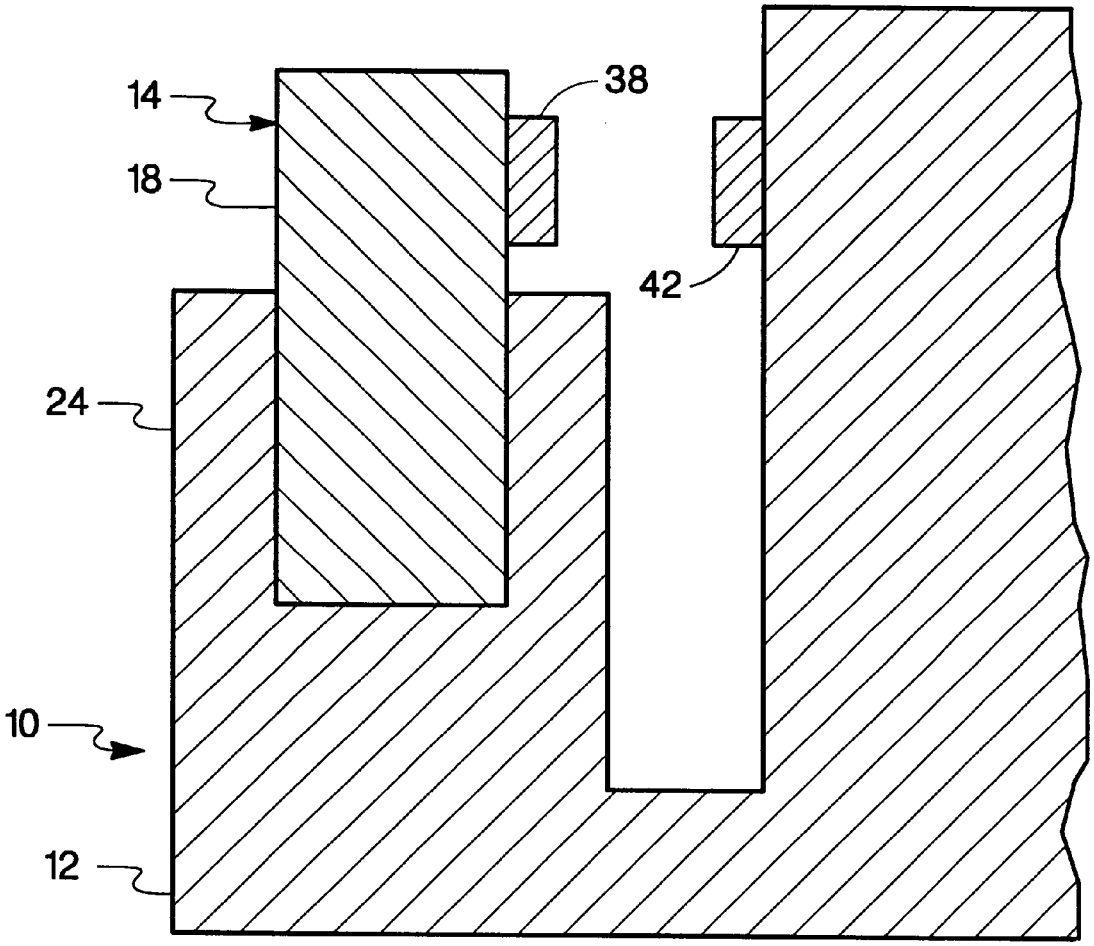
FIG. 6 depicts a simplified representation of the replaceable printing component of the present invention in a docked position with a docking station associated with the printer portion.

FIG. 6 depicts a simplified representation of a docking station 24 for receiving the replaceable printing component 14 into the printer portion 12. The docking station 24 is configured to receive the replaceable printing component 14 such that the linking device 38 is properly positioned with the linking device 42 to be within the capture region 74 such that information can properly be exchanged therebetween. More specifically, the linking device 38 is positioned on the replaceable printing component 14 such that when inserted into the docking station 24, the linking device 38 has both the proper spacing from the linking device 42 as well as the proper orientation relative to the linking device 42. Once the replaceable printing component 14 is properly docked in the docking station 24 the replaceable printing component is restrained to prevent relative movement between the linking device 38 associated with the replaceable printing component and the linking device 42 associated with the printer portion 12.

Applicants' invention makes use of close spacing and controlled orientation between the linking devices 38 and 42 in the docking position to allow optimization of an electric coupling therebetween for information exchange. The use of close spacing and controlled orientation allows the linking device 42 to require only minimal radio frequency power to establish a reliable communication link with the linking device 38. In addition, linking device 38 requires only a minimal antenna size to receive sufficient radio frequency power from linking device 42 to power the linking device 38 and to communicate back to linking device 42. Minimal power requirements for linking device 42 and minimal antenna size requirements for the linking device 38 allow for the use of low cost linking devices 38 and 42 because cost tends to be proportional to power and proportional to antenna size, especially for linking device 38.

In addition, radiated emissions tend to be minimized when the power required from device 42 is minimized. Minimized radiated emissions tend to minimize radio frequency interference with other electrical devices within the printing system 10. Minimized radiated emissions also tend to allow simple shielding to limit radiated emissions to electrical devices outside the printing system 10. Reduced radio frequency interference tends to reduce the manufacturing costs of the printing system 10.

Finally, Applicant's invention limits relative movement between the linking device 38 and linking device 42. By eliminating relative movement between the linking devices 38 and 42 tends to provide more reliable and better coupling between the linking devices 38 and 42 for a given radio frequency power and antenna size. Therefore, use of a fixed orientation with no relative motion where coupling between the linking devices is maximized tends to reduce the cost of the linking devices 38 and 42.

In addition, the use of linking devices 38 and 42 for transferring information between replaceable printing components and the printing system eliminates the need for direct electrical connection between the printing components 14 and the printing system 10. One problem with the use of electrical contacts or terminals positioned on the outer portion of the replaceable printing component is that the electrical contacts associated with the replaceable printing component 14 must properly engage the electrical contacts associated with the docking station or printing system 10 upon insertion of the replaceable printing component into the printing system 10. In order for these electrical contacts to properly mate requires that the alignment tolerance between the replaceable printing component 14 and the printing system be sufficiently small to ensure proper alignment of these electrical contacts. Small alignment tolerances are necessary to ensure the electrical contacts are closely aligned to prevent misregistration between electrical contacts. This misregistration, if severe enough, results in failure to achieve electrical connection between the printing system 10 and the replaceable printing component. As the number of electrical contacts increase the alignment tolerances tend to be further reduced. As these alignment tolerances become smaller, the manufacturing cost of both the docking station 24 as well as the replaceable printing component 14 each tend to increase.

International Patent Application PCT/US98/07324 entitled, Intelligent Printer Components and Printing System, published on Nov. 26, 1998 discloses a printing system that makes use of a media roll that includes an RF ID tag device for storing information related to the media itself. The RF ID tag device is selected to interact with an RF transceiver associated with the printer as the media roll is in motion.

In contrast, Applicant's invention makes use of linking devices 38 and 42 that do not move relative to each other. The spacing between the linking devices 38 and 42 is fixed in a relatively closely spaced relationship which does not change once the replaceable consumable 14 is in the printer portion 12. In addition, the relative orientation of the linking devices 38 and 42 is fixed and does not change in contrast to the media roll that is constantly moving. By positioning each of the linking devices 38 and 42 to be in a closely spaced arrangement that has a fixed spacing and orientation allows the use of low cost linking devices 38 and 42. The use of low cost linking devices 38 and 42 makes possible the use of a non-contact or wireless interface between the replaceable consumable 14 and printer portion 12 in applications which heretofore have been cost prohibitive. In addition, the use of a wireless interface allows the elimination of contacts and electrical conductors as well as the requirement of rigid alignment requirements for the replaceable consumable 14, both of which add to manufacturing costs that increase the overall cost of the printing system. Finally, the use of a wireless interface placed on the replaceable consumable 14 can be made more aesthetically pleasing than the use of electrical contacts on the replaceable consumable.

What is claimed is:

1. A replaceable marking engine for use in a marking machine, the marking engine responsive to control signals for selectively depositing marking material on media, the replaceable marking engine comprising:

a housing associated with the marking canine, the housing configured for docking with the marking machine, the housing having an undocked position, wherein the housing is detached from a receiving station associated with the marking machine, and a docked position, wherein the housing is secured to the receiving station associated with the marking machine;

an electrical storage device mounted to the housing for storing information; and a radio frequency linking device electrically coupled to the electrical storage device and mounted to the housing, wherein the radio frequency linking device is mounted on the housing such that when the marking engine is in the docked position with the marking machine, the radio frequency linking device is within a capture region of and at a specific controlled orientation relative to a corresponding radio frequency linking device associated with the receiving station, such that the radio frequency linking device provides a radio frequency link with the corresponding radio frequency linking device for transferring the information between the marking engine and the marking machine without use of electrical conductors directly connecting the marking engine and the marking machine and only when the radio frequency linking device is positioned within the capture region and at the specific controlled orientation, positioning of the radio frequency linking device outside of the capture region or not at the specific controlled orientation preventing the transfer of information between the marking engine and the marking machine.

2. The replaceable marking engine of claim 1 wherein the radio frequency linking device includes a signal terminal coupled to a power conditioner, and wherein a supply voltage is provided to components of the radio frequency linking device by the power conditioner as a result of a radio frequency signal at the signal terminal of the radio frequency linking device.

3. The replaceable marking engine of claim 1 wherein the marking engine is a replaceable electrophotographic marking engine.

4. The replaceable marking engine of claim 1 wherein the marking engine is a replaceable ink ejection marking engine.

5. The replaceable marking engine of claim 1 wherein in the docked position the radio frequency linking device associated with the marking engine is in close proximity to the corresponding radio frequency linking device associated with the marking machine.

6. The replaceable marking engine of claim 1, wherein the marking engine is a refurbished replaceable marking engine containing a replacement marking material.

7. A replaceable consumable for use in a printing system having at least one replaceable consumable, the replaceable consumable comprising:

a housing associated with the replaceable consumable, the housing configured for docking with a docking station associated with the printing system, the housing having an undocked position, wherein the housing is detached from the docking station, and a docked position wherein the replaceable consumable is secured to the docking station;

an electrical storage device attached to the housing for storing information; and a wireless communication device attached to the housing and electrically coupled to the electrical storage device for transferring the information between the replaceable consumable and the printing system through the atmosphere and without the use of a direct electrical connection between the replaceable consumable and the printing system, wherein the wireless communication device is positioned on the housing such that once the replaceable consumable is in the docked position, the wireless communication device is within a capture region of and at a particular controlled orientation relative to a corresponding wireless communication device associated with the printing system, such that the wireless communication device provides a wireless link with the corresponding wireless communication device for transferring the information between the replaceable consumable and the printing system only when the wireless communication device is positioned within the capture region and at the particular controlled orientation, positioning of the wireless communication device outside of the capture region or not at the particular controlled orientation preventing the transfer of information between the replaceable consumable and the printing system.

8. The replaceable consumable of claim 7 wherein the wireless communication device is a radio frequency link for selectively transferring the information between the replaceable consumable and the printing system without use of electrical conductors directly connecting the replaceable consumable and the printing system.

9. The replaceable consumable of claim 7 wherein the wireless communication device selectively transfers the information between the replaceable consumable and the printing system without use of electrical conductors directly connecting the replaceable consumable and the printing system.

10. The replaceable consumable of claim 7 wherein the wireless communication device includes a signal terminal coupled to a power conditioner, and wherein a supply voltage is provided to components of the wireless communication device by the power conditioner as a result of a radio frequency signal at the signal terminal of the wireless communication device.

11. The replaceable consumable of claim 7 wherein the replaceable consumable is a replaceable electrophotographic marking engine.

12. The replaceable consumable of claim 7 wherein the replaceable consumable is a replaceable ink ejection marking engine.

13. The replaceable consumable of claim 7 wherein in the docked position the wireless communication device associated with the replaceable consumable is in close proximity to the corresponding wireless communication device associated with the printing system.

14. The replaceable consumable of claim 7 wherein the replaceable consumable is a refurbished replaceable consumable and wherein the housing contains a replacement marking media.

15. A method for transferring information between a replaceable consumable and a printing system having at least one replaceable consumable, the method comprising:

inserting the replaceable consumable into a docking station within the printing system such that when in a docked position a wireless communication device associated with the replaceable consumable is in a capture region of and at a specific controlled orientation relative to a corresponding wireless communication device associated with the printing system;

providing a time varying voltage to a signal terminal of the wireless communication device, the time varying voltage being sufficient to induce a supply voltage at a power conditioner coupled to the signal terminal of the wireless communication device associated with the replaceable consumable; and transmitting data, stored in an electrical storage device associated with the replaceable consumable and electrically coupled to the wireless communication device, through the atmosphere from the wireless communication device of the replaceable consumable to the corresponding wireless communication device of the printing system without a direct electrical connection between the replaceable consumable and the printing system and only when the wireless communication device is positioned within the capture region and at the particular controlled orientation, wherein positioning of the wireless communication device outside of the capture region or not at the particular controlled orientation prevents the transmitting of data between the replaceable consumable and the printing system.

16. The method of claim 15 further including transmitting further data through the atmosphere from the corresponding wireless communication device of the printing system to the wireless communication device of the replaceable consumable without direct electrical connection between the replaceable consumable and the printing system.

17. The method of claim 15 wherein the replaceable consumable is a replaceable electrophotographic marking engine and wherein the wireless communication device is a radio frequency linking device.

18. The method of claim 15 wherein the replaceable consumable is a replaceable ink ejection marking engine and wherein the wireless communication device is a radio frequency linking device.

19. A method for preparing a replaceable consumable for communication with a printing system in which the replaceable consumable is to be inserted, the method comprising:

storing information related to the replaceable consumable in a storage device associated with a radio frequency linking device; and affixing the storage device and the radio frequency linking device to the replaceable consumable in a location on the replaceable consumable such that upon insertion of the replaceable consumable into the printing system the radio frequency linking device is within a capture region of and at a specific controlled orientation relative to a corresponding radio frequency linking device associated with the printing system such that the radio frequency linking device provides a radio frequency link with the corresponding radio frequency linking device for transferring the information between the replaceable consumable and the printing system only when the radio frequency linking device is positioned within the capture region and at the specific controlled orientation, wherein positioning of the radio frequency linking device outside of the capture region or not at the specific controlled orientation prevents the transfer of information between the replaceable consumable and the printing system.

20. The method of claim 19 wherein prior to storing information related to the replaceable consumable the method further includes forming the radio frequency linking device such that the radio frequency linking device is capable of receiving inflation from the corresponding radio frequency linking device associated with the printer portion if the radio frequency linking device and the corresponding radio frequency linking device are in close proximity.

21. The method of claim 19, wherein the replaceable consumable is a refurbished replaceable consumable, and wherein the method includes providing a supply of replacement marking media inside the refurbished replaceable consumable.

22. A printing system having a replaceable consumable, the printing system comprising:

a printer portion configured to receive at least one replaceable consumable, the printer portion having a docking station configured to receive the at least one replaceable consumable, the docking station including a first radio frequency linking device;

a replaceable consumable configured to be received within the docking station associated with the printer portion, the replaceable consumable including a second radio frequency linking device; and wherein proper insertion of the replaceable consumable into the docking station associated with the printer portion positions the second radio frequency linking device within a capture region of and at a specific controlled orientation relative to the first radio frequency linking device to allow information to be transferred between the first and second radio frequency linking devices without use of electrical connectors directly connecting the replaceable consumable and the printer portion, and only when the second radio frequency linking device is positioned within the capture region and at the specific controlled orientation thereby allowing the use of relatively low cost short range devices for the first and second radio frequency linking devices, wherein positioning of the second radio frequency linking device outside of the capture region or not at the specific controlled orientation prevents the transfer of information between the replaceable consumable and the printer portion.

* * * * *

UNITED STATES PATENT AND TRADEMARK OFFICE

CERTIFICATE OF CORRECTION

PATENT NO. : 6,312,106 B1
DATED : November 6, 2001
INVENTOR(S) : Ray A. Walker

It is certified that error appears in the above-identified patent and that said Letters Patent is hereby corrected as shown below:

Column 10,
Line 3, "canine" should read -- engine --;

Column 12,
Line 62, "inflation" should read -- information --.

Signed and Sealed this

Eighteenth Day of February, 2003

JAMES E. ROGAN
*Director of the United States Patent and Trademark Office*